US006691884B1

(12) United States Patent
Dwyer

(10) Patent No.: US 6,691,884 B1
(45) Date of Patent: Feb. 17, 2004

(54) PORTABLE COOLER TRAY DEVICE

(76) Inventor: Robert F. Dwyer, 8292 Rte. 21, Arkport, NY (US) 14807

( * ) Notice: Subject to any disclaimer, the term of this patent is extended or adjusted under 35 U.S.C. 154(b) by 77 days.

(21) Appl. No.: 10/053,913

(22) Filed: Jan. 24, 2002

(51) Int. Cl.[7] ..... B65D 6/16
(52) U.S. Cl. ..... 220/4.03; 220/8; 220/571
(58) Field of Search ..... 220/8, 571, 4.03

(56) References Cited

U.S. PATENT DOCUMENTS 3,997,948 A * 12/1976 Hicks et al. ..... 27/2
4,232,983 A * 11/1980 Cook et al. ..... 405/210
4,574,969 A * 3/1986 Mays ..... 220/8
5,078,287 A * 1/1992 Holmes, III ..... 215/11.1
6,079,587 A * 6/2000 Vogt ..... 220/571
6,305,567 B1 * 10/2001 Sulpizio ..... 220/495.11

* cited by examiner

*Primary Examiner*—Joseph Man-Fu Moy

(57) ABSTRACT

A portable cooler tray device for storing foods and beverages on ice while being at a remote location. The portable cooler tray device includes a first tray section; and also includes a second tray section being connected to the first tray section and also being extendable and retractable relative to the first tray section; and further includes a seal for making the first and second tray sections leak-proof.

12 Claims, 5 Drawing Sheets

PORTABLE COOLER TRAY DEVICE

BACKGROUND OF THE INVENTION

1. Field of the Invention

The present invention relates to food/drink-cooling trays and more particularly pertains to a new portable cooler tray device for storing foods and beverages on ice while being at a remote location.

2. Description of the Prior Art

The use of food/drink-cooling trays is known in the prior art. More specifically, food/drink-cooling trays heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,925,933; U.S. Pat. No. 4,777,992; U.S. Pat. No. 4,375,758; U.S. Pat. No. Des. 363,662; U.S. Pat. No. Des. 250,443; and U.S. Pat. No. 3,710,589.

While these devices fulfill their respective, particular objectives and requirements, the aforementioned patents do not disclose a new portable cooler tray device. The prior art discloses trays having slidable sections but which don't have drainage holes and do not have a seal-proof strip of material which allows the tray to hold ice without leaking, all of which is ideally suited for use at remote locations where certain foods and beverages can be conveniently kept cool.

In these respects, the portable cooler tray device according to the present invention substantially departs from the conventional concepts and designs of the prior art, and in so doing provides an apparatus primarily developed for the purpose of storing foods and beverages on ice while being at a remote location.

SUMMARY OF THE INVENTION

The general purpose of the present invention, which will be described subsequently in greater detail, is to provide a new portable cooler tray device which has many of the advantages of the food/drink-cooling trays mentioned heretofore and many novel features that result in a new portable cooler tray device which is not anticipated, rendered obvious, suggested, or even implied by any of the prior art food/drink-cooling trays, either alone or in any combination thereof. The inventive device includes a first tray section; and also includes a second tray section being connected to the first tray section and also being extendable and retractable relative to the first tray section; and further includes a seal for making the first and second tray sections leak-proof.

There has thus been outlined, rather broadly, the more important features of the portable cooler tray device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable cooler tray device which has many of the advantages of the food/drink-cooling trays mentioned heretofore and many novel features that result in a new portable cooler tray device which is not anticipated, rendered obvious, suggested, or even implied by any of the prior art food/drink-cooling trays, either alone or in any combination thereof.

Still another object of the present invention is to provide a new portable cooler tray device for storing foods and beverages on ice while being at a remote location.

Still yet another object of the present invention is to provide a new portable cooler tray device that is easy and convenient to use.

Even still another object of the present invention is to provide a new portable cooler tray device that allows the user to bring foods that need to be kept cold to remote locations where refrigerators and freezers are not found.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
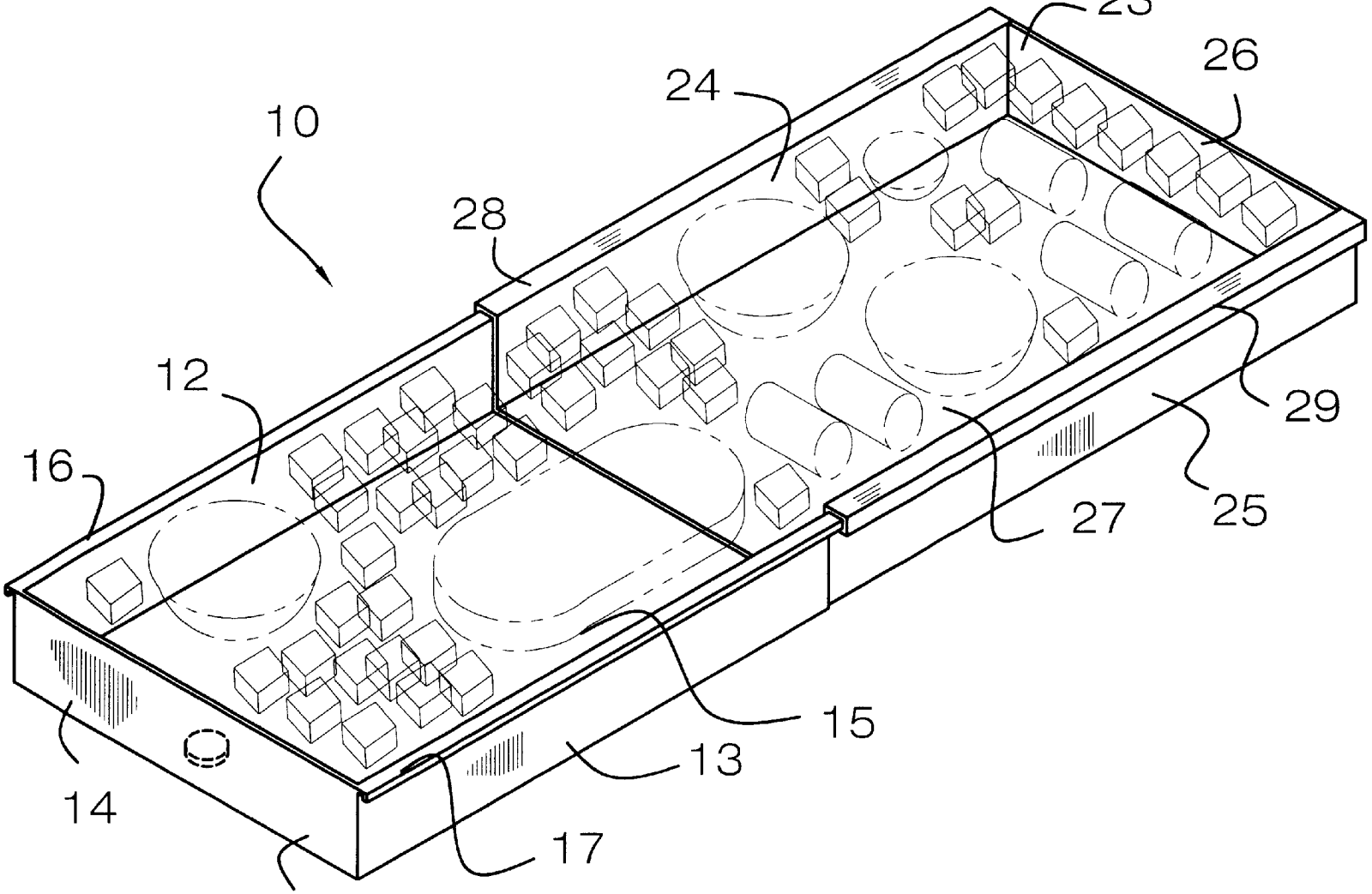
FIG. 1 is a perspective view of a new portable cooler tray device according to the present invention and shown in use in an extended position.
Figure 2:
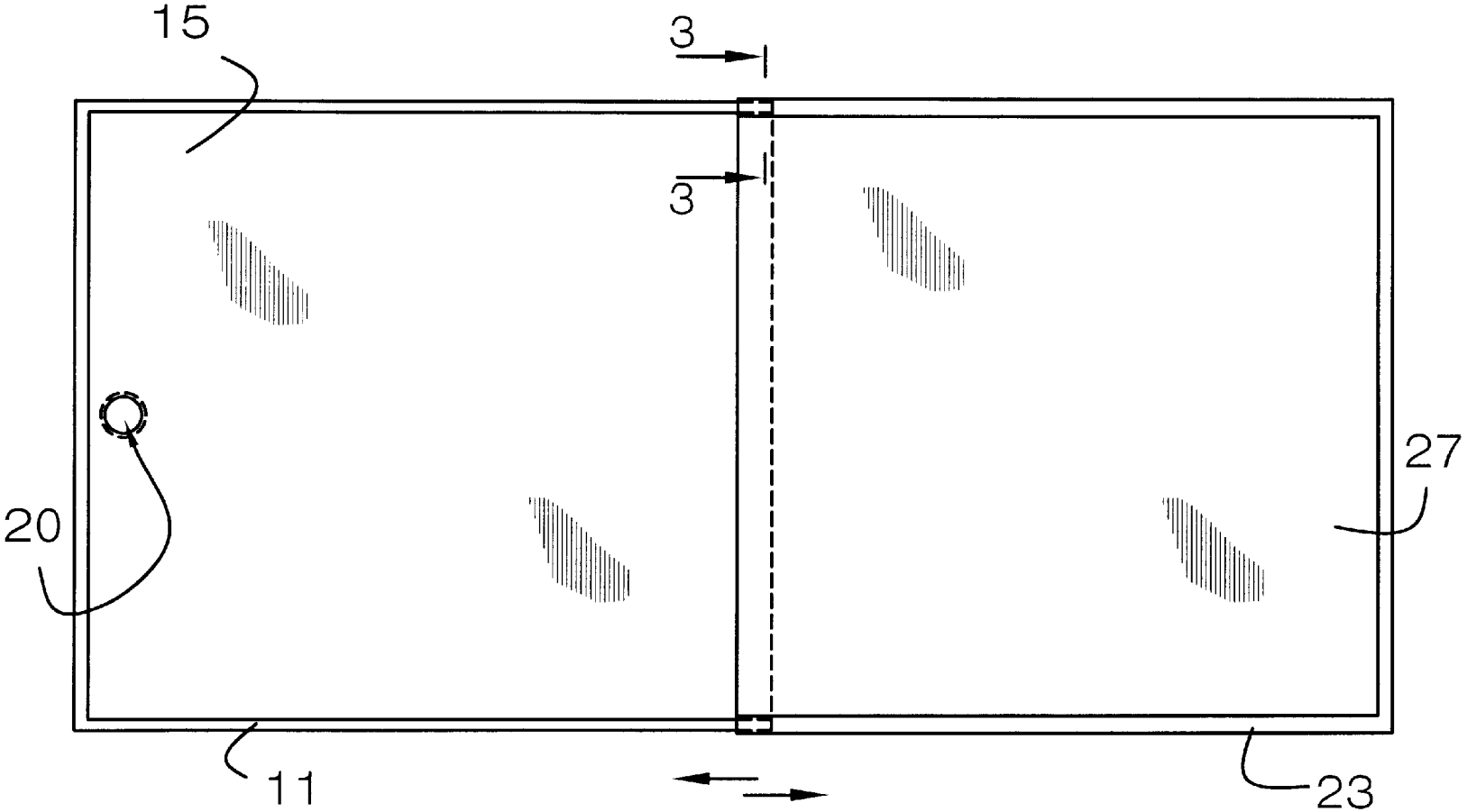
FIG. 2 is a top plan view of the present invention.
Figure 3:
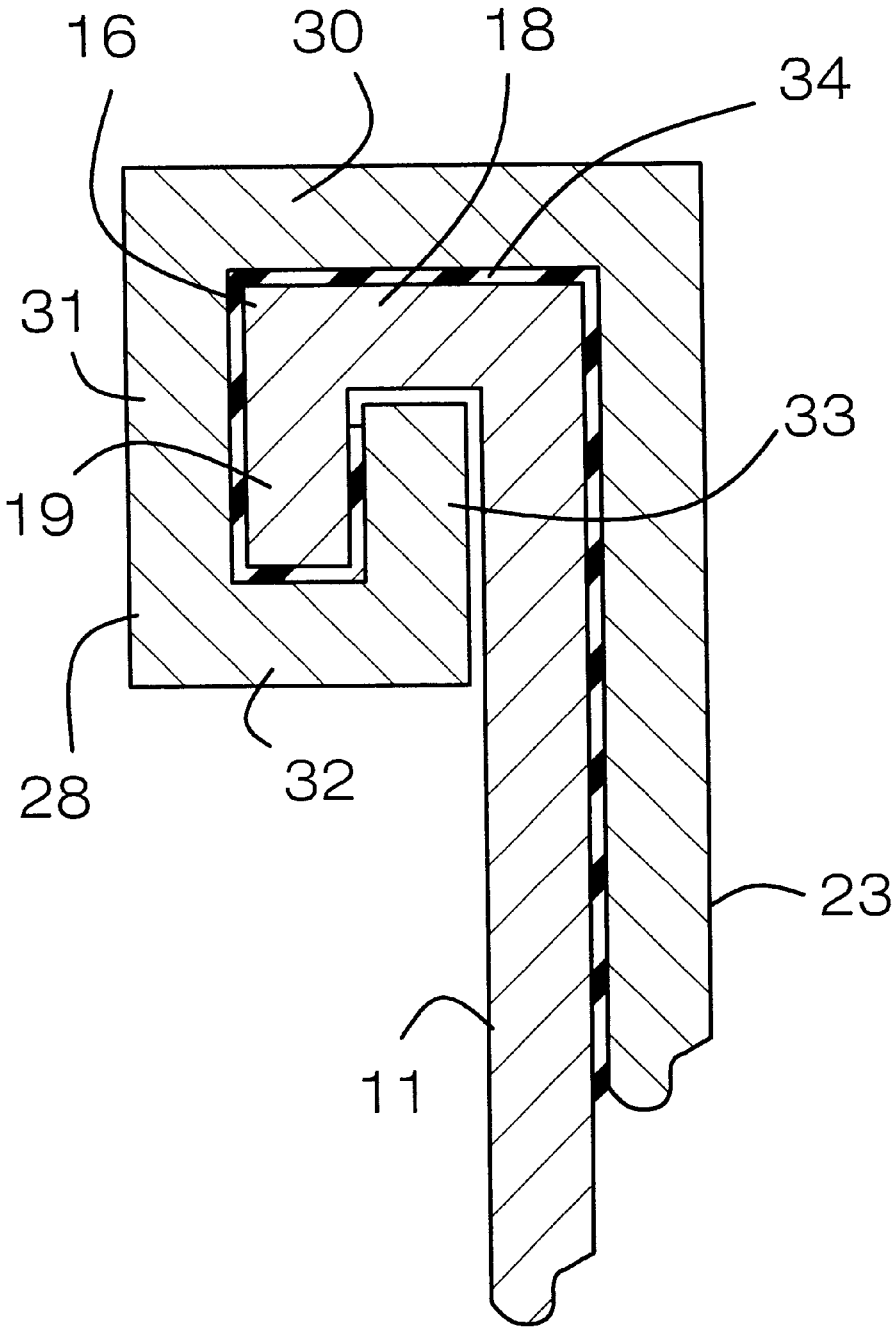
FIG. 3 is a partial cross-sectional view of the lip portions of the present invention.
Figure 4:
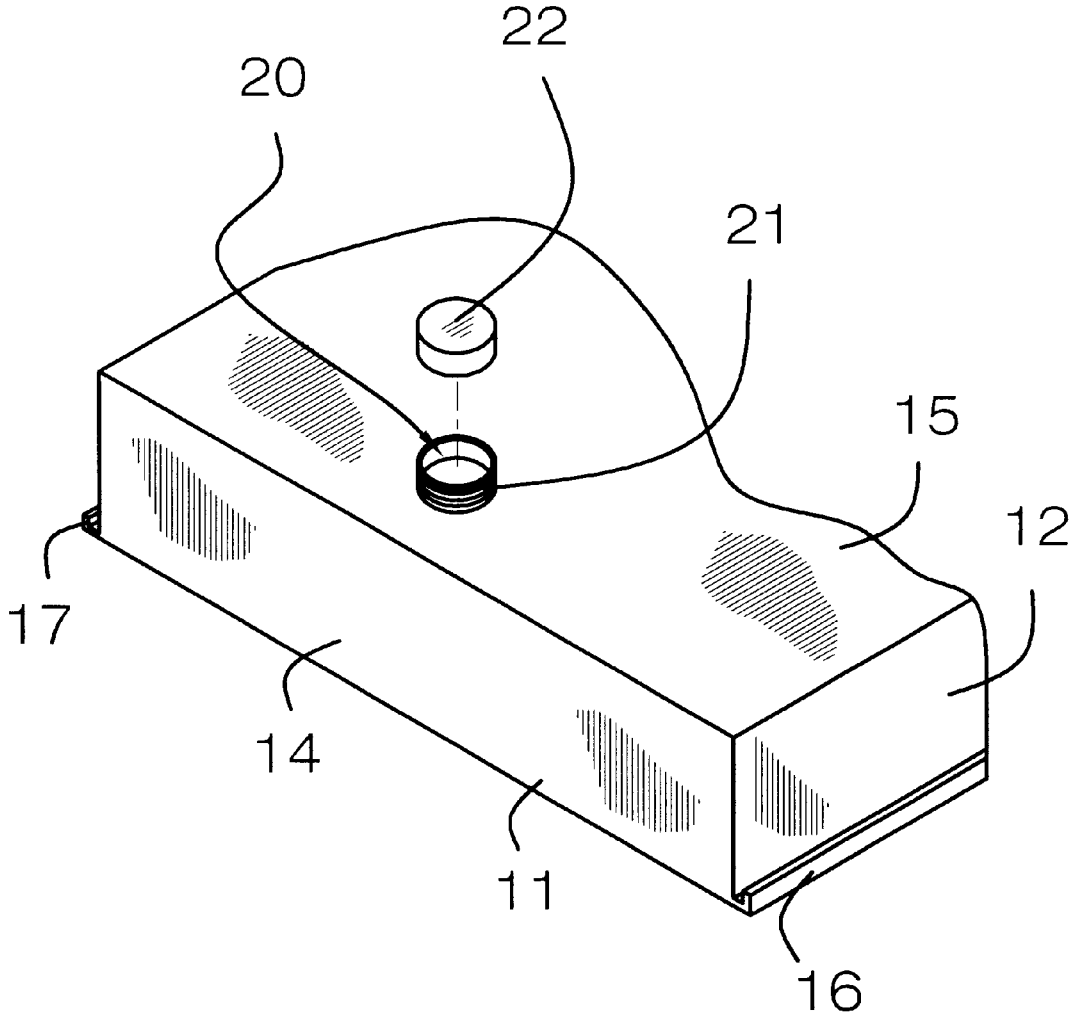
FIG. 4 is a partial bottom perspective view of the present invention.
Figure 5:
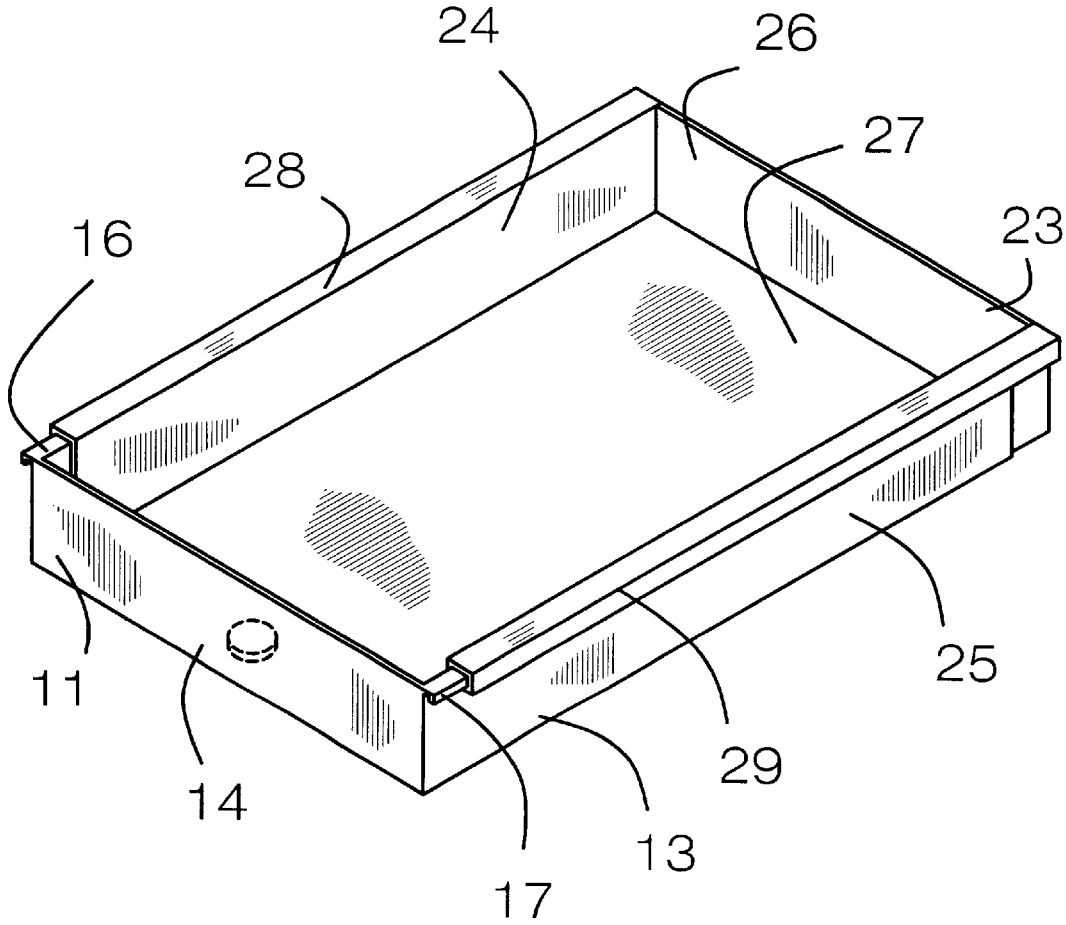
FIG. 5 is a perspective view of the present invention in contracted position.

With reference now to the drawings, and in particular to FIGS. 1 through 5 thereof, a new portable cooler tray device embodying the principles and concepts of the present invention and generally designated by the reference numeral 10 will be described.

As best illustrated in FIGS. 1 through 5, the portable cooler tray device 10 generally comprises a first tray section 11 which includes side, end, and bottom walls 12–15, and also includes an open end, and further includes lip portions 16,17 integrally extending along top edges of the side walls 12,13. Each of the lip portions 16,17 includes a first longitudinal portion 18 which extends outwardly generally perpendicular to a respective side wall 12,13, and also includes a second longitudinal portion 19 which is integrally attached to a longitudinal edge of the first longitudinal portion 18 and which is extended generally perpendicular to the first longitudinal portion.18 and which is spaced from the respective side wall 12,13. The first tray section 11 also includes a hole 20 being disposed through the bottom wall 15 thereof near the end wall, and further includes a drainage spout 21 being conventionally attached to an exterior of the bottom wall 15 and being in fluid communication with the hole 20, and also includes a cap member 22 being removably and conventionally attached to the drainage spout 21. The drainage spout 21 is a tubular member having a wall which has a threaded exterior, and the cap member 22 is threaded upon the tubular member.

A second tray section 23 is connected to the first tray section 11 and is also extendable and retractable relative to the first tray section 11. The second tray section 23 includes side, end, and bottom walls 24–27, and also includes an open end, and further includes lip portions 28,29 conventionally extending along top edges of the side walls 24,25 thereof. Each of the lip portions 28,29 of the second tray section 23 includes a first longitudinal portion 30 which extends outwardly generally perpendicular to a respective side wall 24,25 of the second tray section 23, and also includes a second longitudinal portion 31 which is attached to a longitudinal edge of and generally extended perpendicular to the first longitudinal portion 30 of the second tray section 23, and further includes a third longitudinal portion 32 which is conventionally attached to a longitudinal edge of and extended generally perpendicular to the second longitudinal portion 31 of the second tray section 23 and which is spaced below the first longitudinal section 30 of the second tray section 23, and also includes a fourth longitudinal portion 33 which is integrally attached to a longitudinal edge of and extended generally perpendicular to the third longitudinal portion 32 and which is spaced between the second longitudinal portion 30 and the respective side wall 24,25 of the second tray section 23. The second tray section 23 is movably disposed in and out of the first tray section 11 through the open end of the first tray section 11. The second longitudinal portions 19 of the first tray section 11 is movably disposed between the second and fourth longitudinal portions 31,33 of the second tray section 11. The side walls 24,25 of the second tray section 23 are movably disposed along interiors of the side walls 12,13 of the first tray section 11, and the bottom wall 27 of the second tray section 23 is movably disposed upon a top of the bottom wall 15 of the first tray section 11.

A means for making the first and second tray sections 11,23 leak-proof includes a seal-proof strip of material 34 being conventionally disposed between the first and second tray sections 11,23 to prevent liquid from leaking out of the first and second tray sections 11,23. The seal-proof strip of material 34 is securely and conventionally attached along an edge at the open end of either of the first and second tray sections 11,23, and is disposed between the lip portions 16,17,28,29 of the first and second tray sections 11,23.

In use, the user places the first and second tray sections 11,23 upon a level surface and makes sure that the cap member 22 is attached to the drainage spout 21 to effectively close the hole 20 in the first tray section 11. The user then fills the first and second tray sections 11,23 with ice, and places foods and beverages in the first and second tray sections 11,23 amongst the ice to keep the foods and beverages cool. Once finished, the user can remove the cap member 22 from the drainage spout 21 so that the water from the melting ice can be effectively drained from the first and second tray sections 11,23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable cooler tray device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable cooler tray device comprising:

a first tray section;

a second tray section being connected to said first tray section and also being extendable and retractable relative to said first tray section; and a means for making said first and second tray sections leak-proof.

2. A portable cooler tray device as described in claim 1, wherein said first tray section includes side, end, and bottom walls, and also includes an open end, and further includes lip portions extending along top edges of said side walls.

3. A portable cooler tray device as described in claim 2, wherein each of said lip portions includes a first longitudinal portion which extends outwardly generally perpendicular to a respective said side wall, and also includes a second longitudinal portion which is attached to a longitudinal edge of said first longitudinal portion and which is extended generally perpendicular to said first longitudinal portion and which is spaced from the respective said side wall.

4. A portable cooler tray device as described in claim 3, wherein said first tray section also includes a hole being disposed through said bottom wall thereof near said end wall, and further includes a drainage spout being attached to an exterior of said bottom wall and being aligned with said hole, and also includes a cap member being removably attached to said drainage spout.

5. A portable cooler tray device as described in claim 4, wherein said drainage spout is a tubular member having a wall which has a threaded exterior, said cap member being threaded upon said tubular member.

6. A portable cooler tray device as described in claim 3, wherein said second tray section includes side, end, and bottom walls, and also includes an open end, and further includes lip portions extending along top edges of said side walls thereof.

7. A portable cooler tray device as described in claim 6, wherein each of said lip portions of said second tray section includes a first longitudinal portion which extends outwardly generally perpendicular to a respective said side wall of said second tray section, and also includes a second longitudinal portion which is attached to a longitudinal edge of and generally extended perpendicular to said first longitudinal portion of said second tray section, and further includes a third longitudinal portion which is attached to a longitudinal edge of and extended generally perpendicular to said second longitudinal portion of said second tray section and which is spaced below said first longitudinal section of said second tray section, and also includes a fourth longitudinal portion which is attached to a longitudinal edge of and extended generally perpendicular to said third longitudinal portion and which is spaced between said second longitudinal portion and the respective said side wall of said second tray section.

8. A portable cooler tray device as described in claim 7, wherein said second tray section is movably disposed in and out of said first tray section through said open end of said first tray section.

9. A portable cooler tray device as described in claim 8, wherein said second longitudinal portions of said first tray section is movably disposed between said second and fourth longitudinal portions of said second tray section.

10. A portable cooler tray device as described in claim 9, wherein said side walls of said second tray section are movably disposed along interiors of said side walls of said first tray section, and said bottom wall of said second tray section is movably disposed upon a top of said bottom wall of said first tray section.

11. A portable cooler tray device as described in claim 10, wherein said means for making said first and second trays leak-proof includes a seal-proof strip of material being disposed between said first and second tray sections to prevent liquid from leaking out of said first and second tray sections.

12. A portable cooler tray device as described in claim 11, wherein said seal-proof strip of material is securely attached along an edge at said open end of either of said first and second tray sections, and is disposed between said lips portions of said first and second tray sections.

* * * * *